US008287251B2

(12) United States Patent
Weber

(10) Patent No.: US 8,287,251 B2
(45) Date of Patent: Oct. 16, 2012

(54) VARIABLE RATIO HAND PUMP

(75) Inventor: Fredericus Johannes Weber, Lunteren (NL)

(73) Assignee: Actuant Corporation, Menomonee Falls, WI (US)

( * ) Notice: Subject to any disclaimer, the term of this patent is extended or adjusted under 35 U.S.C. 154(b) by 417 days.

(21) Appl. No.: 12/527,638

(22) PCT Filed: Feb. 18, 2008

(86) PCT No.: PCT/US2008/054211

§ 371 (c)(1),
(2), (4) Date: Aug. 18, 2009

(87) PCT Pub. No.: WO2008/103628

PCT Pub. Date: Aug. 28, 2008

(65) Prior Publication Data

US 2010/0034678 A1 Feb. 11, 2010

Related U.S. Application Data

(60) Provisional application No. 60/890,557, filed on Feb. 19, 2007.

(51) Int. Cl.

| | |
|---|---|
| ***F04B 25/00*** | (2006.01) |
| ***F04B 3/00*** | (2006.01) |
| ***F04B 5/00*** | (2006.01) |
| ***F04B 49/00*** | (2006.01) |

(52) U.S. Cl. ..... 417/254; 417/218; 60/479

(58) Field of Classification Search ..... 417/254, 417/540, 544, 218, 212, 213; 92/140; 60/479
See application file for complete search history.

(56) References Cited

U.S. PATENT DOCUMENTS

| | | | | |
|---|---|---|---|---|
| 2,070,935 | A * | 2/1937 | Traut | 60/452 |
| 2,423,162 | A | 7/1947 | Summers | |
| 2,436,916 | A * | 3/1948 | Copeland | 254/1 |
| 2,472,104 | A * | 6/1949 | Grant et al. | 417/218 |
| 2,547,055 | A | 4/1951 | Stephens | |
| 2,777,375 | A * | 1/1957 | Carlin et al. | 172/8 |
| 2,891,480 | A | 6/1959 | Marcum | |
| 2,940,397 | A | 6/1960 | Mattos | |
| 3,792,747 | A * | 2/1974 | Knutson | 180/89.15 |
| 4,026,493 | A | 5/1977 | Anderson | |
| 4,142,368 | A | 3/1979 | Mantegani | |
| 5,065,983 | A | 11/1991 | Slay | |
| 5,779,457 | A | 7/1998 | Chuang et al. | |
| 6,079,956 | A | 6/2000 | Maliszewski | |
| 6,158,973 | A | 12/2000 | Maliszewski | |
| 2006/0127233 | A1 | 6/2006 | Sasayama et al. | |
| 2006/0127254 | A1 | 6/2006 | Bakker et al. | |

OTHER PUBLICATIONS http://www.technologystudent.com/cams/link1.htm Published: Dec. 18, 2005 Obtained via web.archive.org/.*

The International Search Report and Written Opinion as mailed on Jul. 25, 2008 for International Patent Application PCT/US2008/054211.

European Patent Office, Extended European Search Report, Application No. 08730083.6, Dec. 16, 2010.

* cited by examiner

*Primary Examiner* — Devon Kramer
*Assistant Examiner* — Thomas Fink
(74) *Attorney, Agent, or Firm* — Quarles & Brady LLP

(57) ABSTRACT

A hand operated hydraulic pump has a cam that is pivoted by a compensation cylinder that rotates the cam so as to move the pivot of an operating handle closer to the pump plunger as the output pressure of the pump increases.

8 Claims, 1 Drawing Sheet

VARIABLE RATIO HAND PUMP

CROSS-REFERENCE TO RELATED APPLICATION

This application claims the benefit of PCT International Application No. PCT/US2008/054211 filed on Feb. 18, 2008, which claims the benefit of U.S. Provisional Patent Application No. 60/890,557 filed on Feb. 19, 2007, which is incorporated by reference herein.

STATEMENT CONCERNING FEDERALLY SPONSORED RESEARCH OR DEVELOPMENT

Not applicable.

FIELD OF THE INVENTION

This invention relates to hydraulic hand pumps and in particular to hand pumps that vary the lever pivot point dependent on output pressure of the pump.

BACKGROUND OF THE INVENTION

Hydraulic hand pumps in which a hand operated lever is pivotable against a plunger of a pump, which may be either a two stage or a single stage pump, are well known. In most such pumps, the pivot point of the lever is fixed regardless of the output pressure of the pump. However, it has been recognized that reducing the distance between the lever pivot point and pump plunger reduces the amount of force required to be applied to produce a given pressure. In most systems of this type, a compensation cylinder is subjected to the output pressure of the pump, and the lever is pivoted to a plunger of the compensation cylinder, so that as the compensation cylinder extends, it moves the lever pivot point toward the pump plunger, thereby reducing the moment arm between the lever pivot point and the pump plunger to reduce the force required to operate the pump. Such a patent, for example, is U.S. Pat. No. 3,792,747, the disclosure of which is hereby incorporated by reference in its entirety.

Such systems result in lateral loading on the compensation cylinder and premature failure. The present invention addresses these concerns.

SUMMARY OF THE INVENTION

The present invention provides a hand operated hydraulic pump in which the lever pivot is to a cam. The cam is pivoted, at a distance away from the lever pivot, to the housing of the pump. The compensation cylinder, which is subjected to the output pressure of the pump, acts on the cam to rotate the cam above the housing pivot so as to reduce the distance from the lever pivot to the pump plunger as the output pressure of the pump increases. This reduces the moment arm between the lever pivot and the pump plunger, which has the effect of reducing the amount of force required to be exerted by the user on the handle of the lever to produce any given pump output pressure.

In a preferred aspect, the cam pivots are arranged in a manner so that operating the lever at a low pressure tends to maximize the distance between the lever pivot and the pump plunger, so as to maximize flow rate for lower pressures. In addition, the compensation device is preferably biased in this direction.

The foregoing and other advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
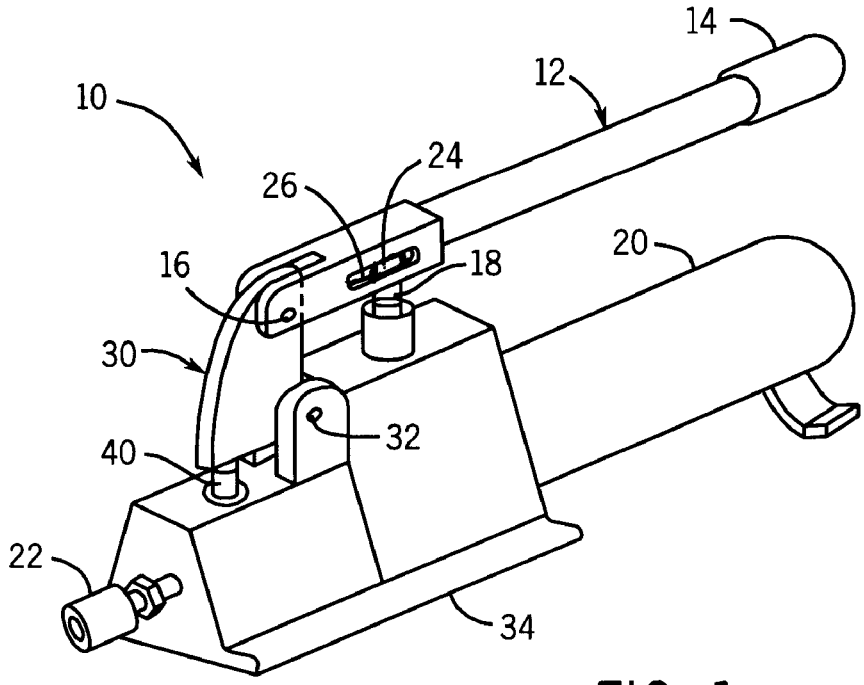
FIG. 1 is a perspective view of a pump incorporating the invention.

Referring to FIG. 1, a hand operated hydraulic pump 10 of the invention has a lever 12 with a handle 14 and a pivot 16. The lever 12 is operable by handle 14 to pivot back and forth about pivot 16 to reciprocate plunger 18 of a pumping unit 19 of the pump 10 so as to pump hydraulic fluid out of reservoir 20 to pressure port 22. Plunger 18 extends through a slot in the bottom of lever 12 and has a head 24 that reciprocates back and forth in slot 26 as the lever 12 is pivoted up and down. Hydraulic hoses or other lines can be connected to pressure port 22 so as to provide hydraulic fluid under pressure to a load such as a hydraulic cylinder and return hydraulic fluid to the reservoir 20 from the load upon the actuation of a return valve (not shown).

The lever 12 is pivoted at pivot 16 to a cam 30 which is pivoted at pivot 32 to housing 34 of the pump 10. Pivot 32 is spaced below pivot 16 and may be slightly toward plunger 40 so that as the lever 12 is operated, when pushing down on handle 14 the cam 30 is pivoted against the plunger 40 of compensation cylinder 42 of the pump 10. Preferably, when the line between pivots 16 and 32 is parallel to the plunger 18 axis, the plunger 40 is in its fully retracted position.

It is noted that the pumping unit 19 of which the plunger 18 is a part may have a two stage or a single stage piston.

Thus, the cam 30 is in a generally three point configuration, the three points being pivot 16 to lever 12, pivot 32 to the housing 34 and the point of contact with the plunger 40. As such, the cam 30 can be made in a generally triangular form.

Figure 2:
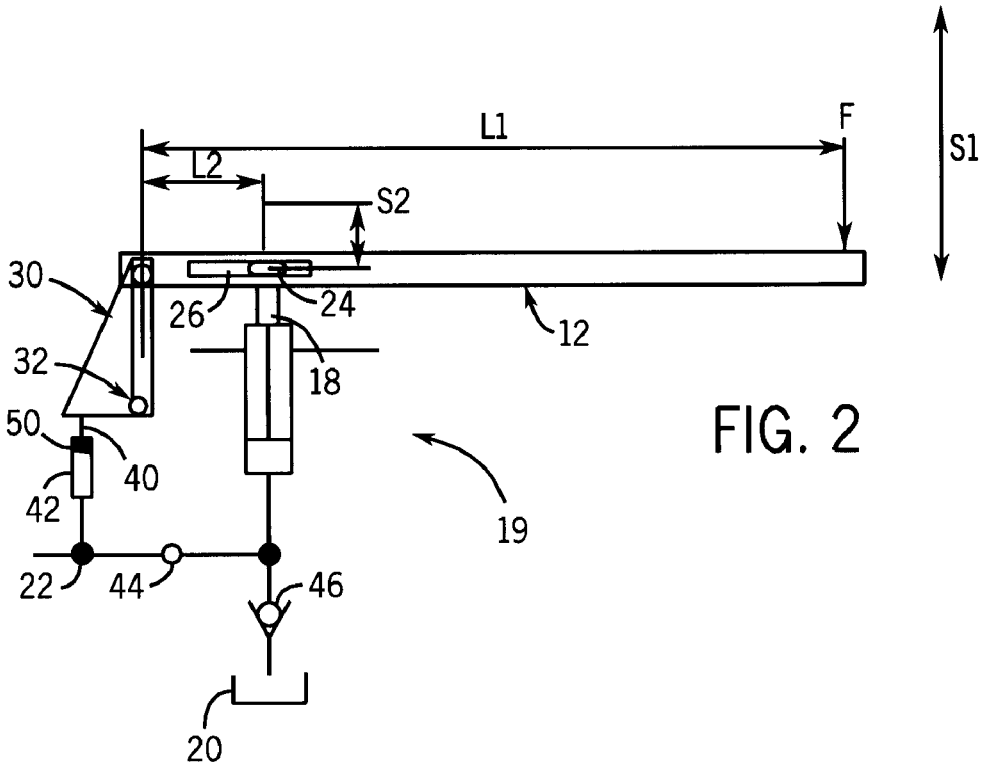
FIG. 2 is a schematic view illustrating the operation of the pump.

Referring to FIG. 2, the compensation cylinder 42 is in communication with the outlet pressure of pumping unit 19 through the one-way check valve 44. Pumping unit 19 sucks hydraulic fluid from reservoir 20 via check valve 46. As the output pressure at port 22 goes up, compensation cylinder 42 is pressurized to a greater extent against the bias of spring 50 and the force of the cam 30 tending to retract the plunger 40 (when the handle 14 is operated). When the pressure in cylinder 42 is sufficient to overcome these forces, the plunger 40 pushes against the cam 30 and rotates the cam 30 clockwise as viewed in FIG. 2 about pivot 32, which reduces the distance L2 between pivot 16 and plunger 18. When this happens, the lever 12 slides relative to the plunger and head 24, with the head 24 sliding in the slot 26 and the plunger 18 sliding in a slot on the underside of lever 12. The distance L1, which is the distance between the handle 14 and the pivot 16, remains constant, so the force required to be applied to the handle 14 to produce a given pressure in the pumping unit 19 is reduced by this action. The stroke S2, which is proportional to the volumetric flow rate from the pump, is also reduced for a given stroke S1 applied to the handle 14. When the load pressure at port 22 subsides, operation of the lever 12 and the spring 50 return the plunger 40 to a retracted position to maximize the stroke S2 and therefore maximize the flow rate for a given input stroke S1.

Thereby, there are minimal or no side loads applied to the plunger 40 and consequently on the piston of compensation cylinder 42. Instead, the loading of operating the lever 12 is born by the cam 30. The cam 30, moved by the plunger 40 in relation to the output pressure, helps to reduce the effort of operating the lever 12 at higher pressures.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. In a hand operated hydraulic pump having a lever, the lever including a handle and a pivot, the pump including a pumping unit with a plunger that engages the lever between the handle and the pivot, the handle being operable to reciprocate the plunger so as to pump hydraulic fluid as the lever is pivoted back and forth, the improvement wherein:

the pivot of the lever is pivoted to a cam at a lever pivot;

the cam is pivoted to a frame of the pump at a frame pivot, the frame pivot on the cam being spaced away from the lever pivot such that pivoting the cam about the frame pivot changes the distance between the lever pivot and the plunger of the pumping unit; and a compensation device that is subjected to the output pressure of the pump and slidingly engages the cam so as to rotate the cam about the frame pivot in relation to the output pressure of the pump so as to reduce the distance between the lever pivot and the plunger of the pumping unit as the output pressure increases.

2. A hand operated hydraulic pump as claimed in claim 1, wherein the operating handle when pivoted against the plunger of the pumping unit tends to rotate the cam back against rotation of the cam by the compensation device so as to increase the distance between the lever pivot and the plunger of the pumping unit.

3. A hand operated hydraulic pump as in claim 1, wherein the compensation device is a cylinder and a plunger of the compensation device rotates the cam as the output pressure of the pump increases.

4. A hand operated hydraulic pump as claimed in claim 1, wherein the compensation device is biased to retract and thereby increase the distance from the lever pivot to the pump plunger.

5. A hand operated hydraulic pump as claimed in claim 1, wherein the plunger of the pumping unit slides in a slot of the lever.

6. A hand operated hydraulic pump as claimed in claim 1, wherein the cam is generally triangular.

7. A hand operated hydraulic pump, comprising:

a housing including a pressure port;

a pumping unit supported by the housing and including a first plunger being movable to draw hydraulic fluid from a reservoir and deliver the hydraulic fluid to the pressure port;

a compensation cylinder supported by the housing and including a second plunger being movable in response to the hydraulic fluid being delivered to the pressure port;

a cam slidingly engaging the second plunger and pivotally connected to the housing at a housing pivot spaced apart from the second plunger, the cam pivoting about the housing pivot in response to movement of the second plunger; and a lever having a first end pivotally connected to the cam at a lever pivot spaced apart from the second plunger and the housing pivot, the lever having a user handle at a second end, and a slot slidably receiving the first plunger between the first end and the second end, and the lever moving such that the lever pivot moves closer to the first plunger as the cam pivots about the housing pivot to reduce an amount of force required to pivot the lever.

8. A hand operated hydraulic pump as claimed in claim 7, wherein the cam has a generally triangular shape, the second plunger engages the cam along a first leg of the triangular shape, the lever pivot is located along a second leg of the triangular shape, and the housing pivot is located at an intersection of the first leg and the second leg.

* * * * *